United States Patent [19]

Erickson

[11] Patent Number: 4,582,341

[45] Date of Patent: Apr. 15, 1986

[54] SKI POLE MODIFYING APPARATUS

[76] Inventor: John S. Erickson, 11201 SE. Third - 39G, Everett, Wash. 98204

[21] Appl. No.: 712,219

[22] Filed: Mar. 15, 1985

Related U.S. Application Data

[63] Continuation-in-part of Ser. No. 549,774, Nov. 8, 1983.

[51] Int. Cl.[4] ..... A63C 11/22

[52] U.S. Cl. ..... 280/824; 280/819; 297/438

[58] Field of Search ..... 280/819, 820, 824, 816; 297/438, 439

[56] References Cited

U.S. PATENT DOCUMENTS

| | | | |
|---|---|---|---|
| 3,199,886 | 8/1965 | Dover | 280/824 |
| 4,358,138 | 11/1982 | Laughlin | 280/819 |

FOREIGN PATENT DOCUMENTS

| | | | |
|---|---|---|---|
| 268121 | 1/1969 | Austria | 280/820 |
| 2101611 | 7/1971 | Fed. Rep. of Germany | 280/820 |

*Primary Examiner*—John A. Pekar
*Assistant Examiner*—Joseph G. McCarthy
*Attorney, Agent, or Firm*—Arthur L. Urban

[57] ABSTRACT

Ski pole modifying apparatus includes a seat contacting member and a ski/boot contacting member. The seat contacting member includes a pole encircling portion with an elongated collar section. An arm portion extends from the collar section and includes a transverse section extending the full length of the arm portion disposed in a plane substantially perpendicular to an axis of the collar section. A radial section extends from the periphery of the collar section along substantially the full height thereof and tapers downwardly toward the free end of the transverse section. The ski/boot contacting member includes a platform portion with a central opening surrounded by a cylindrical section and an odd number of substantially equal length peripheral edges with a minimum of five. A generally circular opening extends through the platform portion adjacent a midpoint of each peripheral edge thereof. Each circular opening includes a channel communicating with the adjacent peripheral edge with the channel having a width less than the diameter of the circular opening. A reinforcing portion extends downwardly from the platform portion with a rib section extending toward each circular opening. A stiffening section extends to one corner of the platform portion radially from the cylindrical section along substantially the full height thereof tapering upwardly to the corner and also extends downwardly from the platform portion.

18 Claims, 6 Drawing Figures

SKI POLE MODIFYING APPARATUS

This application is a continuation-in-part of pending application Ser. No. 549,774, filed Nov. 8, 1983.

This invention relates to a novel apparatus and more particularly relates to a new apparatus for modifying ski poles.

People have enjoyed skiing for many years. Originally, skiing was done as a means of transportation and involved so-called cross-country skiing. Cross-country skiing enabled a person to move across snow covered areas more rapidly than by walking or using snowshoes.

More recently, so-called downhill skiing has become very popular. This type of skiing involves skiing down hills or mountains and is done as a sport rather than for transportation. In the initial years of downhill skiing, persons had to expend considerable effort and ingenuity to get to the top of the slope in order to be at a starting point for the downhill runs. At that time, an individual had to walk up the hill carrying his skis. Being a skier then required a person to be in excellent physical condition in order to be able to climb the slopes.

Since most people did not wish to undertake such climbing, ski tows or lifts were developed as a means of getting to the top of the mountains. Also, as downhill skiing became more popular, new businesses were started which offered many types of new equipment, clothing and accessories for skiers. Such new items made skiing easier and more convenient so that the average person could enjoy the sport and become reasonably proficient.

With the development of lifts and skiing equipment, skiers were able to spend more time skiing instead of getting to the top of the mountain. The greater amount of time spent in skiing and the fact that people in average condition were skiing, resulted in skiers becoming tired during a day's outing. In order to overcome this tiredness, skiers had to rest their bodies.

Resting usually is accomplished by stopping at intervals along the slopes or by spending time in a lodge or warming hut. While these expedients do provide rest for the skier's body, most skiers try to minimize their rest periods in order to get in a maximum amount of skiing in a given period of time.

This is because skiers generally have to travel long distances to the ski areas and can only ski a limited number of times. Also, the expenses involved in skiing are considerable both in the investment in equipment and clothing and also in lift tickets.

To reduce the cost of each skiing hour, skiers try to spread the cost over the maximum number of actual skiing hours. In order to accomplish this result, it is necessary to maximize the amount of actual skiing done on each skiing day. However, maximizing the skiing requires that rest periods be virtually eliminated.

While to a casual observer it would appear that the lift rides would be excellent rest periods, most ski lifts are not designed for this purpose. Lifts transport skiers to the top of the mountain rather than provide a high degree of skier comfort and rest.

A particular deficiency of most ski lifts is the lack of support for the skier's legs. Although a few lifts have foot rests, the great proportion of the lifts provide no foot or leg support whatsoever. The skier simply sits on the lift seat and dangles his legs.

The lack of support for the legs is a problem any time a person is sitting on a seat in which his legs do not reach the floor, but it is a much more serious problem for skiers who are wearing relatively heavy boots and skis on their feet. The extra weight of this equipment tends to tire the legs more even than when the skier's legs and feet are in contact with the ground as he skis down a slope or run.

Through the years skiers have attempted to solve the problem of leg fatigue during lift rides. Some individuals try to hook the tips of their skis into the straps on their ski pole grips. This involves reversing and manipulating the poles which may be uncomfortable. It also requires concentration and strength to hold the poles in place. Other skiers have tried lengths of cord which they tie to the lift and slip under their skis. This arrangement requires considerable dexterity and effort.

Another problem with such makeshift efforts is that all of the activity must be accomplished while the skier is sitting on a lift chair that is high above the ground. Since these expedients require that the skier direct his attention to the task at hand rather than concentrating on holding on to the lift, the risk of falling from the lift and incurring injury is greatly increased. As a result, only a very few skiers use such devices and the great proportion of skiers simply become tired and frustrated.

From the above discussion, it is clear that past and present methods and devices for providing support for skiers' legs while riding a ski lift leave much to be desired. Thus, there is a need for new products that overcome the deficiencies of previous devices.

The present invention provides a novel ski pole modifying apparatus that overcomes the shortcomings of previous leg support devices. The ski pole modifying apparatus of the present invention provides effective leg support for a skier riding a lift. Ski poles with the modifying apparatus can be positioned for leg support easily and removed when not needed quickly and conveniently. The apparatus of the invention does not interfere with the use of the ski poles while skiing or during transport.

The ski pole modifying apparatus of the invention is simple in design and can be produced relatively inexpensively. The apparatus can be fabricated from commercially available materials and components. Conventional manufacturing techniques and procedures and semiskilled labor can be employed in its production.

The modifying apparatus of the invention can be mounted on a ski pole easily by persons with ordinary mechanical skills and experience after a minimum of instruction. The apparatus can be mounted on a wide variety of different ski poles. The apparatus can be utilized both on ski poles presently in use as well as on new poles that are being manufactured.

The ski pole modifying apparatus is durable in construction and has a long useful life. Little, if any, maintenance is required to keep the apparatus in working condition. The apparatus can be changed from one set of poles to another if desired easily and quickly.

The ski pole modifying apparatus of the invention can be used safely by persons of all ages. Little instruction is required to enable a skier to use the apparatus efficiently and conveniently. The apparatus can be adapted easily to fit different skiers and the growth of youngsters.

These and other benefits and advantages of the novel ski pole modifying apparatus of the present invention will be apparent from the following description and the accompanying drawings in which.

Figure 1:
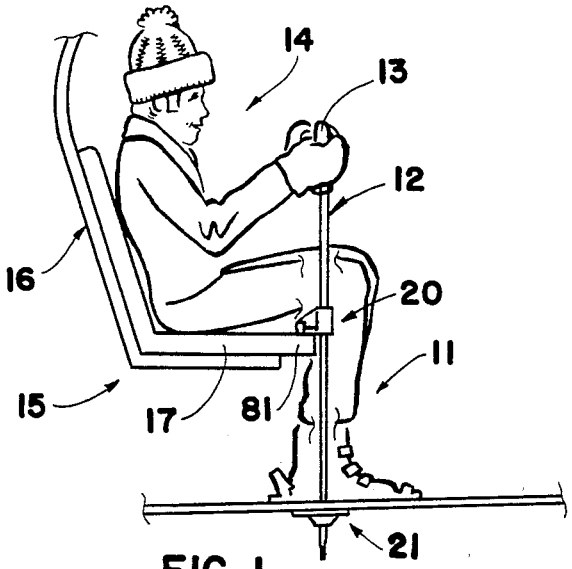
FIG. 1 is a schematic illustration of one form of the ski pole modifying apparatus of the invention in use while mounted on a ski pole.

As shown in the drawings, one form of the ski pole modifying apparatus 11 of the present invention is mounted on a ski pole 12. The ski pole 12 which includes a grip 13 is being used by a skier 14 riding a lift 15. The lift 15 includes a chair 16 with a seat 17 on which the skier is seated.

The ski pole modifying apparatus 11 of the present invention includes a seat contacting member 20 and a ski/boot contacting member 21. Advantageously, the seat contacting member and ski/boot contacting member are unitary structures as shown in the drawings.

The seat contacting member 20 of the apparatus 11 of the invention includes a pole encircling portion 22. The pole encircling portion includes an elongated collar section 23. An arm portion 24 extends from the pole encircling portion. The arm portion includes a transverse section 25 that extends the full length of the arm portion. The transverse section is disposed in a plane substantially perpendicular to the axis of the collar section 23.

The collar section 23 advantageously has a height greater than the width of the transverse section 25. The transverse section 25 preferably has a width more than one-half the outer diameter of the collar section. Advantageously, the arm portion and the transverse section have a length greater than the outer diameter of the collar section.

A radial section 27 extends upwardly from the transverse section 25. The radial section extends along substantially the full length of the transverse section. The radial section 27 also extends from the periphery of the collar section 23 along substantially the full height thereof. The radial section tapers downwardly from the collar section toward the free end 28 of the transverse section. The radial section 27 preferably includes an enlargement 29 at an end 30 thereof that is remote from the collar section.

Figure 5:
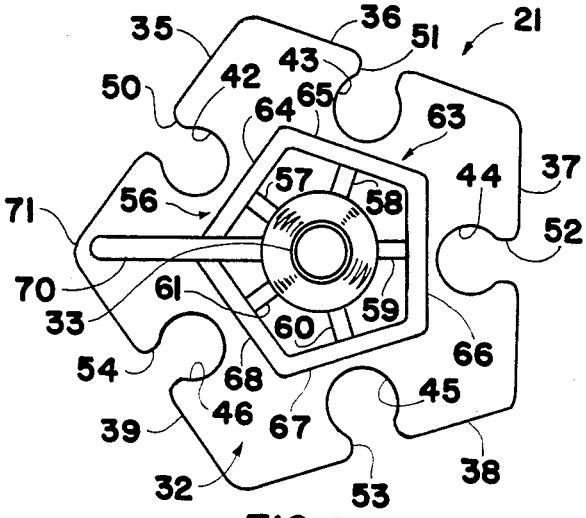
FIG. 5 is an enlarged bottom view of a ski/boot contacting member of the ski pole modifying apparatus shown in FIGS. 1 and 2.
Figure 4:
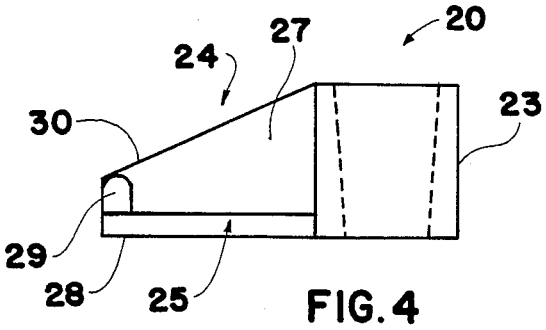
FIG. 4 is a side view of the seat contacting member of the ski pole modifying apparatus shown in FIG. 3.
Figure 6:
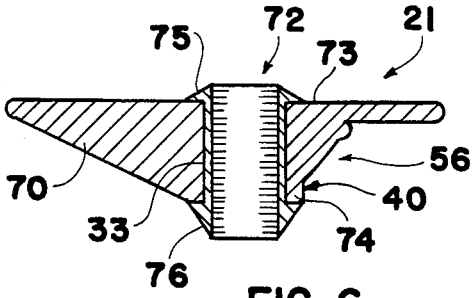
FIG. 6 is a side view in section of the ski/boot contacting member of the ski pole modifying apparatus shown in FIG. 5.

Ski/boot contacting member 21 of the ski pole modifying apparatus 11 of the present invention includes a platform portion 32. The platform portion includes a central opening 33 therethrough. The platform portion also includes an odd number of equal length peripheral edges 35, 36, 37, 38 and 39. The platform portion 32 includes a minimum of five edges as shown in FIG. 5. A cylindrical section 40 extends downwardly from the platform portion around the central opening 33.

A generally circular opening 42, 43, 44, 45 or 46 extends through the platform portion 32 adjacent a midpoint of each peripheral edge 35–39 thereof. Each circular opening 42–46 includes a channel 50, 51, 52, 53 or 54. Each channel communicates with the adjacent peripheral edge. Each channel has a width less than the diameter of the associated circular opening.

Advantageously, the circular openings have the same diameter as the central opening 33 through the platform portion 32. The channels preferably have a width more than about one-half the diameter of the circular openings 42–46.

A reinforcing portion 56 of the boot contacting member 21 extends downwardly from the platform portion 32 in the same direction as the cylindrical section 40. The reinforcing portion 56 includes a plurality of spaced rib sections 57, 58, 59, 60 and 61. The rib sections extend radially from the cylindrical section 40. One of the rib sections 57–61 extends from the cylindrical section toward each cylindrical opening 42–46.

The rib sections advantageously taper from the cylindrical section 40 to the circular openings. Preferably, the rib sections extend to the circular openings.

Advantageously, the reinforcing portion 56 includes a continuous rib section 63. The continuous rib section 63 includes the same number of sides 64, 65, 66, 67 and 68 as the number of edges of the platform portion 32. The sides of the continuous rib section are substantially parallel to the peripheral edges 35–39 of the platform portion. The sides 64–68 of the continuous rib section are disposed intermediate the peripheral edges 35–39 and the cylindrical section 40.

A stiffener section 70 extends from the cylindrical section 40 to one corner 71 of the platform portion 32. The stiffener section 70 extends radially from the cylindrical section along substantially the full height thereof. The stiffener section also tapers downwardly to the corner 71 of the platform portion 32.

The cylindrical section 40 of the boot contacting member 21 advantageously includes a metal sleeve insert 72. The sleeve insert preferably extends beyond the ends 73 and 74 of the cylindrical section. It is desirable for the sleeve insert to include enlarged end flanges 75 and 76.

The seat contacting member 20 and ski/boot contacting member 21 of the ski pole modifying apparatus 11 of the present invention can be fabricated from any of a variety of different materials including metals, plastics, wood, combinations thereof and the like. Advantageously, the members 20 and 21 are unitary structures and preferably are molded plastic structures.

To use the novel ski pole modifying apparatus 11 of the present invention as shown in the drawings, seat contacting members 20 and boot contacting members 21 are mounted on the ski poles 12 of the skier 14. First, the baskets (not shown) already on the poles are removed by driving the pole tip through the basket opening.

To mount a seat contacting member 20 on the pole 12, the collar section 23 of the member 20 is slid over the pole tip with the transverse section 25 closest to the tip. The member 20 is pushed along the pole toward the grip 13 to a point therealong that is at the same distance from the tip as the distance the top of the user's knee cap is from the ground. Since the opening of the collar section tapers in the same way as the pole, the member 20 will wedge tightly to the pole.

One of the seat contacting members 20 on the poles of the skier will be positioned slightly above the member 20 on the companion pole. With this orientation, the transverse sections of the respective arm portions will be at the same elevation when the boot contacting members 21 are interlocked on the poles as shown in FIG. 2.

If the pole grips 13 are of a type which are grasped by the hand in a special alignment, the arm portions 24 should be rotated on the respective poles so the arm portions will extend in the same direction in a parallel relationship when being used as will be described hereinafter.

Ski/boot contacting member 21 is mounted on a pole 12 by sliding the central opening 33 or the sleeve insert 72 therein over the pole tip with the reinforcing portion 56 closest to the tip. The opening 33 and the insert 72 are tapered so the member 21 will wedge tightly to the pole.

Figure 2:
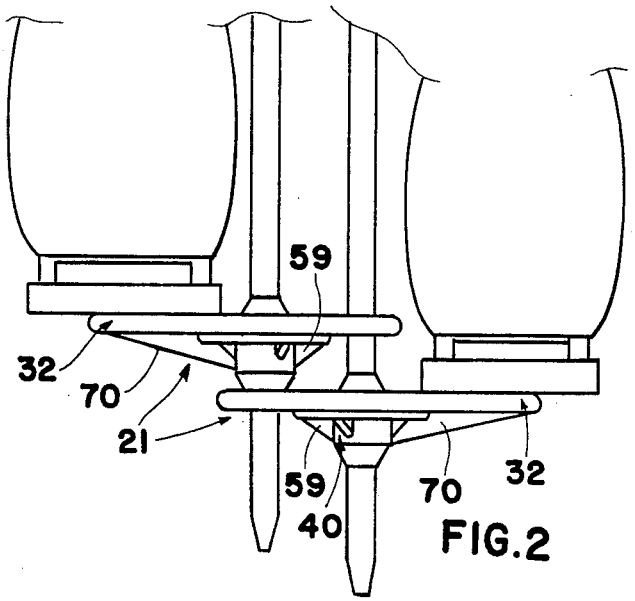
FIG. 2 is an enlarged fragmentary right side view of the ski pole modifying apparatus shown in FIG. 1.
Figure 3:
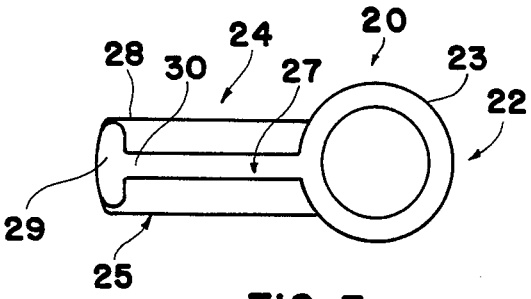
FIG. 3 is an enlarged top view of the seat contacting member of the ski pole modifying apparatus shown in FIG. 1.

Again, if the pole grips fit the hand in a specific alignment, the boot contacting member 21 should be rotated on the pole so the stiffener section 70 extends outwardly from the interlocked poles as shown in FIG. 2. The poles with the ski pole modifying apparatus 11 of the invention mounted thereon are now ready for use.

In using the ski pole modifying apparatus 11 of the invention after getting onto ski lift chair 16 and being seated, the skier 14 places the poles next to one another and clips the boot contacting members 21 together. This is accomplished by raising one member 21 above the other as shown in FIG. 2 and sliding one pole through channel 52 and into the circular opening 44 of the member 21 on the adjacent pole. In the same way, the second pole is slid through the channel 52 of the member 21 on the first pole and into its circular opening 44. The poles are now locked together.

With the skier grasping the grips 13, the poles are placed between the skier's legs and the seat contacting members 20 which are extending rearwardly toward the seat 17 are positioned against the seat edge 81 with the poles against the edge of the seat and the transverse sections 25 of the arm portions 24 resting on the upper surface of the seat.

Thereafter, the skier places the ski bottom portions located under his boots on the upper surface of the platform portions 32 as shown in FIG. 2 while pulling the pole grips 13 toward his body to maintain the poles against the seat edge. Once the skis are comfortably positioned on the platform portions, the pull on the pole grips can be eased allowing the pole tops to move away from the user's body slightly but with the poles still in contact with the seat edge.

The skier can maintain his skis in this position until the top of the lift is reached and it is time to unload. Then, the skier simply lifts his skis from the interlocked boot contacting members 21 and releases the seat contacting members 20 from the seat 17. The poles are separated by sliding the pole tips from the respective circular openings 44 of the companion pole and the skier is ready to leave the lift.

The skier now uses his poles in the normal manner until he boards a chair lift again. At that time, he repeats the above steps so he can rest his legs.

The above description and the accompanying drawings show that the present invention provides a novel ski pole modifying apparatus with advantages and features not found in previous devices. The ski pole modifying apparatus provides effective leg support for a skier riding a lift which heretofore was not attainable. The modifying apparatus can be positioned for use quickly and conveniently. The apparatus does not interfere with normal skiing activity.

The ski pole modifying apparatus of the present invention is simple in design and can be produced relatively inexpensively. Commercially available materials and components and conventional manufacturing techniques can be employed in its fabrication. The apparatus is durable in construction and has a long useful life with a minimum of maintenance.

The modifying apparatus can be installed on ski poles easily by persons with limited mechanical experience after a minimum of instruction. The apparatus can be adapted to fit different types of ski poles. The apparatus can be adjusted easily for persons of all ages and body configurations.

It will be apparent that various modifications can be made in the particular apparatus described in detail and shown in the drawings within the scope of the invention. The size, configuration and arrangement of components can be changed to meet specific requirements. These and other changes can be made in the ski pole modifying apparatus provided the functioning and operation thereof are not adversely affected. Therefore, the scope of the present invention is to be limited only by the following claims.

What is claimed is:

1. Ski pole modifying apparatus including a seat contacting member and a ski/boot contacting member; said seat contacting member including a pole encircling portion with an elongated collar section, an arm portion extending from said collar section, said arm portion including a transverse section extending the full length of said arm portion, said transverse section being disposed in a plane substantially perpendicular to an axis of said collar section, a radial section extending upwardly from said transverse section along substantially the full length thereof, said radial section also extending from the periphery of said collar section along substantially the full height thereof and tapering downwardly toward the free end of said transverse section; said ski/boot contacting member including a platform portion with a central opening therethrough, said platform portion including an odd number of substantially equal length peripheral edges with a minimum of five, a cylindrical section extending downwardly from said platform portion around said central opening, a generally circular opening through said platform portion adjacent a midpoint of each peripheral edge thereof, each circular opening including a channel communicating with said adjacent peripheral edge, said channel having a width less than the diameter of said circular opening, a reinforcing portion extending downwardly from said platform portion in the same direction as said cylindrical section, said reinforcing portion including a plurality of spaced rib sections extending radially from said cylindrical section, one of said rib sections extending from said cylindrical section toward each circular opening, a stiffening section extending from said cylindrical section to one corner of said platform portion, said stiffening section extending radially from said cylindrical section along substantially the full height thereof and tapering upwardly to said corner, said stiffening section also extending downwardly from said platform portion; whereby said seat contacting member is mounted on a ski pole intermediate along the length thereof and said ski/boot contacting member is mounted on said ski pole adjacent a free end thereof remote from a grip so said seat contacting member can rest on a ski lift seat enabling a skier to rest his feet on said ski/boot contacting member.

2. Ski pole modifying apparatus according to claim 1 wherein said seat contacting member is a unitary structure.

3. Ski pole modifying apparatus according to claim 1 wherein said seat contacting member is a molded plastic structure.

4. Ski pole modifying apparatus according to claim 1 wherein said collar section has a height greater than the width of said transverse section.

5. Ski pole modifying apparatus according to claim 1 wherein said transverse section of said arm portion has a width more than one-half the outer diameter of said collar section.

6. Ski pole modifying apparatus according to claim 1 wherein said arm portion has a length greater than the outer diameter of said collar section.

7. Ski pole modifying apparatus according to claim 1 wherein said radial section has an enlargement at an end thereof remote from said collar section.

8. Ski pole modifying apparatus according to claim 1 wherein said ski/boot contacting member is a unitary structure.

9. Ski pole modifying apparatus according to claim 1 wherein said ski/boot contacting member is a molded plastic structure.

10. Ski pole modifying apparatus according to claim 1 wherein said platform portion has five peripheral edges.

11. Ski pole modifying apparatus according to claim 1 wherein said circular openings through said platform portion have the same diameter as said central opening thereof.

12. Ski pole modifying apparatus according to claim 1 wherein said channels have a width more than about one-half the diameter of said circular openings.

13. Ski pole modifying apparatus according to claim 1 wherein said rib sections taper from said cylindrical section to said circular openings.

14. Ski pole modifying apparatus according to claim 1 wherein said rib sections extend to said circular openings.

15. Ski pole modifying apparatus according to claim 1 wherein said reinforcing portion includes a continuous rib section with the same number of sides as said platform portion, said continuous rib section including sides substantially parallel to said platform edges and intermediate said edges and said cylindrical section.

16. Ski pole modifying apparatus according to claim 1 wherein said cylindrical section includes a metal sleeve insert.

17. Ski pole modifying apparatus according to claim 16 wherein said sleeve insert extends beyond the ends of said cylindrical section.

18. Ski pole modifying apparatus according to claim 17 wherein said sleeve insert includes enlarged end flanges.

* * * * *